US007390987B2

(12) United States Patent
Madar et al.

(10) Patent No.: US 7,390,987 B2
(45) Date of Patent: Jun. 24, 2008

(54) METHOD OF HANDLING POSTAL OBJECTS USING DYNAMIC OVERFLOW

(75) Inventors: François Madar, Bourg les Valence (FR); Bruno Cartal, Montelier (FR); Franck Girodet, Montelier (FR)

(73) Assignee: Solystic, Gentilly Cedex (FR)

( * ) Notice: Subject to any disclaimer, the term of this patent is extended or adjusted under 35 U.S.C. 154(b) by 165 days.

(21) Appl. No.: 11/389,303

(22) Filed: Mar. 27, 2006

(65) Prior Publication Data

US 2006/0219611 A1 Oct. 5, 2006

(30) Foreign Application Priority Data

Mar. 29, 2005 (FR) ..... 05 50797

(51) Int. Cl.
*B07C 5/00* (2006.01)

(52) U.S. Cl. ..... 209/584; 209/900; 700/224; 700/226

(58) Field of Classification Search ..... 209/583, 209/584, 900; 700/223–227
See application file for complete search history.

(56) References Cited

U.S. PATENT DOCUMENTS 5,421,464 A * 6/1995 Gillmann et al. ..... 209/584
5,472,309 A * 12/1995 Bernard et al. ..... 414/807
5,901,855 A * 5/1999 Uno et al. ..... 209/584
6,881,916 B2 * 4/2005 McLaughlin et al. ..... 209/584
7,170,024 B2 * 1/2007 Burns et al. ..... 209/584
2007/0012603 A1 * 1/2007 Park et al. ..... 209/584

FOREIGN PATENT DOCUMENTS

WO WO 94/16829 A1 8/1994

* cited by examiner

*Primary Examiner*—Joseph C Rodriguez
(74) *Attorney, Agent, or Firm*—Sughrue Mion, PLLC

(57) ABSTRACT

In a method for sorting postal objects in a sorting machine comprising sorting outlets with movable trays for the storage of the postal objects, respective logical destinations (DL) are associated to the sorting outlets and some sorting outlets of the machine are reserved, called reserved sorting outlets, without logical destination association. In case of the detection of a tray overflowing in a sorting outlet (DP'), the postal objects intended to this overflowing sorting outlet are directed to a reserved sorting outlet (DP") extracted (40) from a logical waiting list (36) of reserved sorting outlets, an index is associated (32) to the empty tray of the reserved sorting outlet, the overflowing sorting outlet is inserted (42) into said waiting list and an empty tray is loaded (46) in the overflowing sorting outlet in the place of the full tray.

6 Claims, 3 Drawing Sheets

METHOD OF HANDLING POSTAL OBJECTS USING DYNAMIC OVERFLOW

PRIOR ART

The present invention relates to a method for sorting postal objects in a sorting machine comprising sorting outlets with movable trays for the storage of postal objects, in which respective sorting logical destinations are associated to the sorting outlets and some sorting outlets are reserved, called reserved sorting outlets, without logical destination association, and in which in case of the detection of an overflow of a tray in a sorting outlet, the postal objects intended to this overflowing sorting outlet are directed to a reserved sorting outlet and the logical destination of the overflowing sorting outlet is associated to this reserved sorting outlet.

The invention is carried more particularly on a postal sorting machine with a carrousel of buckets for sorting large size postal objects known as "flats" in which the postal objects circulate in the buckets above the sorting outlets. During a sorting process, the postal objects are deposited in the trays placed in the sorting outlets and when a tray is full, it is replaced by an empty tray by means of an automated tray replacement system being for example part of an automated tray handling system known as "ATHS".

The replacement of a full tray by an empty tray in a sorting outlet takes few seconds. During this few seconds, the concerned sorting outlet is in overflow state and can not receive postal objects. The postal objects intended to this overflowing sorting outlet are then re-circulated in the carrousel, which means that this postal objects stays in the buckets of the carrousel and make a round turn of the carrousel before being deposited, or rejected of the automatic sorting process.

Re-circulating postal objects in the carrousel penalises the operational throughput of the sorting machine because the objects stay in the buckets of the carrousel which are not empty anymore to receive new postal objects at the injection point. Further, when there is a need to keep the carrousel injection sequence (order) of the postal objects, for example during the preparation of the carrier walk, it is not possible to re-circulate postal objects and those postal objects have to be rejected. The postal objects rejected of the automatic sorting process have to be sorted manually, generating consequently important overcost and damaging the postal objects.

A solution consists in associating several consecutive sorting outlets to a single logical destination so that when a sorting outlet is in overflow state, the postal objects intended to this sorting outlet are directed to the following sorting outlet. This solution penalises the operational flow rate of the machine because less logical destinations can be sorted in the machine owing to the fact that several sorting outlets are reserved for a single logical destination.

A method as above described is also known from the patent application US2004/0159592. In such a method, sorting outlets without logical destination association are reserved all along the machine and when a sorting outlet is in overflow state, the sorting outlets placed upstream (or downstream according to the evacuation place of the full trays) starting from the overflowing sorting Outlet are scanned one after the other and the logical destination of the overflowing sorting outlet is associated to the first sorting outlet with an empty tray.

It is an object of the invention to provide an other method for sorting postal objects.

SUMMARY OF THE INVENTION

To this end, the invention provides a method for sorting postal objects in a sorting machine comprising sorting outlets with movable trays for the storage of the postal objects, in which respective logical destinations are associated to the sorting outlets and some sorting outlets of the machine are reserved, called reserved sorting outlets, without logical destination association, and in which in case of the detection of an overflow of a tray in a sorting outlet, the postal objects intended to this overflowing sorting outlet are directed to a reserved sorting outlet and the logical destination of the overflowing sorting outlet is associated to this reserved sorting outlet, wherein the method comprises the steps consisting in:

a) extracting said reserved sorting outlet in a logical waiting list of reserved sorting outlets;

b) associating to the empty tray of the reserved sorting outlet an index representative of a chronological order association number of the association of a tray to a logical destination;

c) inserting the overflowing sorting outlet in said waiting list of reserved sorting outlets, loading an empty tray in the overflowing sorting outlet in the place of the full tray and evacuating the full tray of the sorting machine.

The method according to the invention enables to anticipate the replacement of trays and to impact on the association of the logical destinations to the sorting outlets of the machine if it is noticed that a postal object must be deposited in a sorting outlet during the time interval needed by the tray replacement. Each logical destination is associated at any time to a sorting outlet.

The method according to the invention further presents the following particularities:

different logical states are given to the sorting outlets, this logical states corresponding to different availability levels of the sorting outlets and the sorting outlets are classified in said logical waiting list on the basis of their availability, and the reserved sorting outlet extracted at step a) in the logical waiting list is the one with the highest availability level;

the reserved sorting outlets with the same logical state are classified according to their position in the machine in order to balance the full tray flow onto full tray evacuation conveyors placed on each side of the machine;

the classification of the reserved sorting outlets in the waiting list is re-evaluated each time a sorting outlet is inserted into the logical waiting list or each time a logical state of a reserved sorting outlet changes;

a sorting outlet associated to a logical destination is permuted with a reserved sorting outlet of the logical waiting list when the availability level of said sorting outlet associated to a logical destination is higher than the availability levels of the reserved sorting outlets.

The above and other objects, features and advantages of the present invention will become apparent from the following detailed description when taken with accompanying drawings. This description is only given as an example and is not a limitation of the invention.

DETAILED DESCRIPTION OF THE PREFERRED EMBODIMENTS

Figure 1:
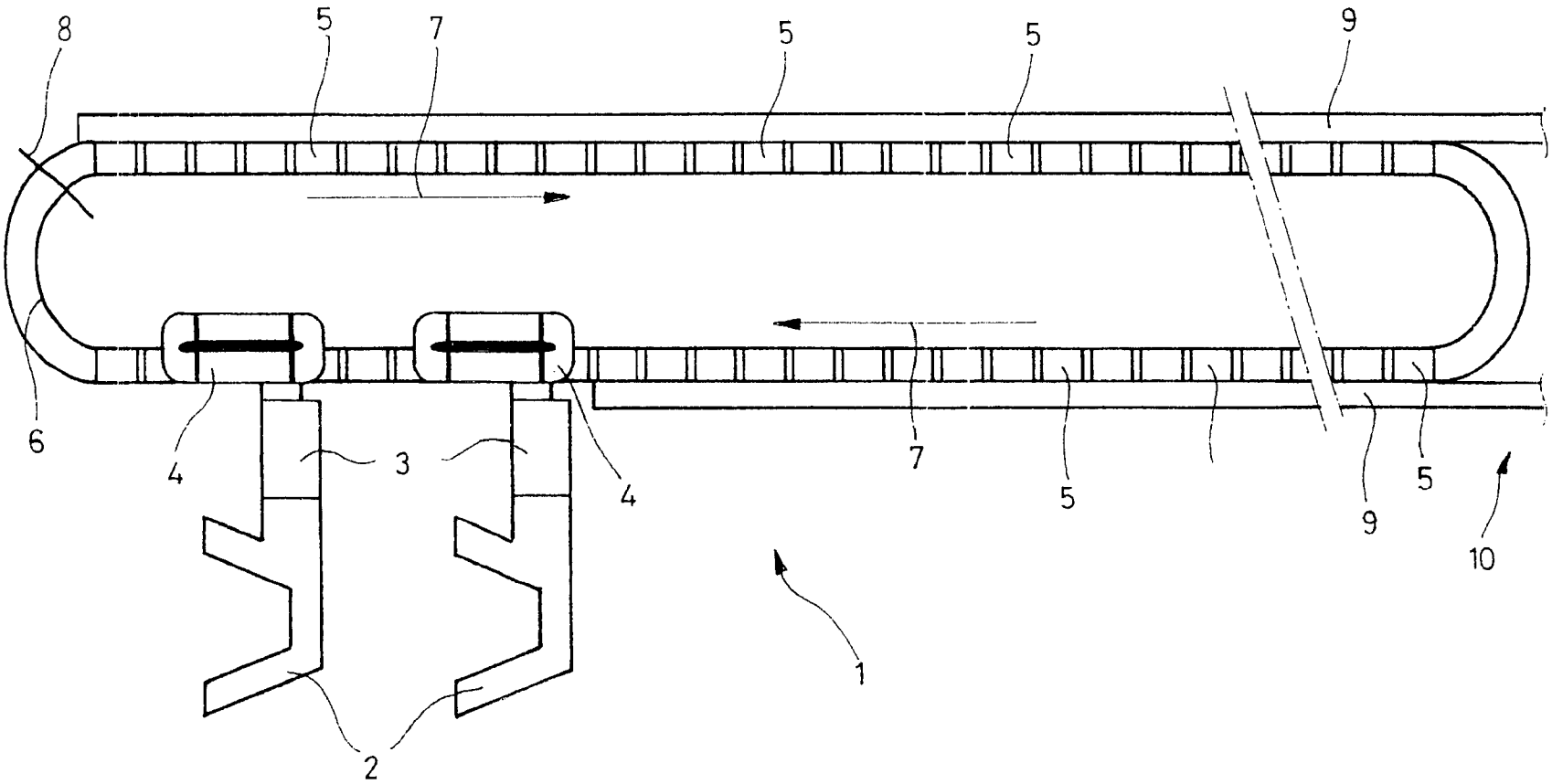
FIG. 1 is a schematic view of a postal sorting machine with a carrousel of buckets arranged to implement the method according to the invention.

A machine 1 to sort postal objects is represented on FIG. 1. This sorting machine 1 comprises two feeders 2 to destack and convey one by one the postal objects to automatic address recognition and thickness measurement devices 3. The postal objects are then injected in an injection carrousel 4 and inserted in the buckets 5 of a carrousel 6 which circulate in the direction indicated by the arrow 7 above a plurality of sorting outlets provided with trays (not shown). Each bucket 5 transports normally a single postal item up to a sorting outlet.

The address as well as the thickness e of each postal object are determined in the device 3 and kept in memory in a database. To the postal address of each object corresponds a logical destination, that is a routing point, a distribution point of a carrier walk or a set of distribution or routing points according to the postal treatment realized, and to each logical destination is associated a sorting outlet according to a current sorting plan. The sorting plan evolves dynamically during the sorting.

The sorting outlet S associated to the logical destination DL of a current postal object E and thus toward which this current postal object must be directed is determined when the bucket containing the current object passes at the level of a decision point represented on FIG. 1 by reference 8. This determination is performed as late as possible, that is a bit before the current object arrives above the sorting outlets.

The trays placed in the sorting outlets are moved onto an evacuation conveyor 9 when they are full and evacuated from the sorting machine by an evacuation end 10. The trays are conveyed by the evacuation conveyor up to a tray sequencing device (non-shown) arranged to store and classify the trays according to a determined order.

Figure 2:
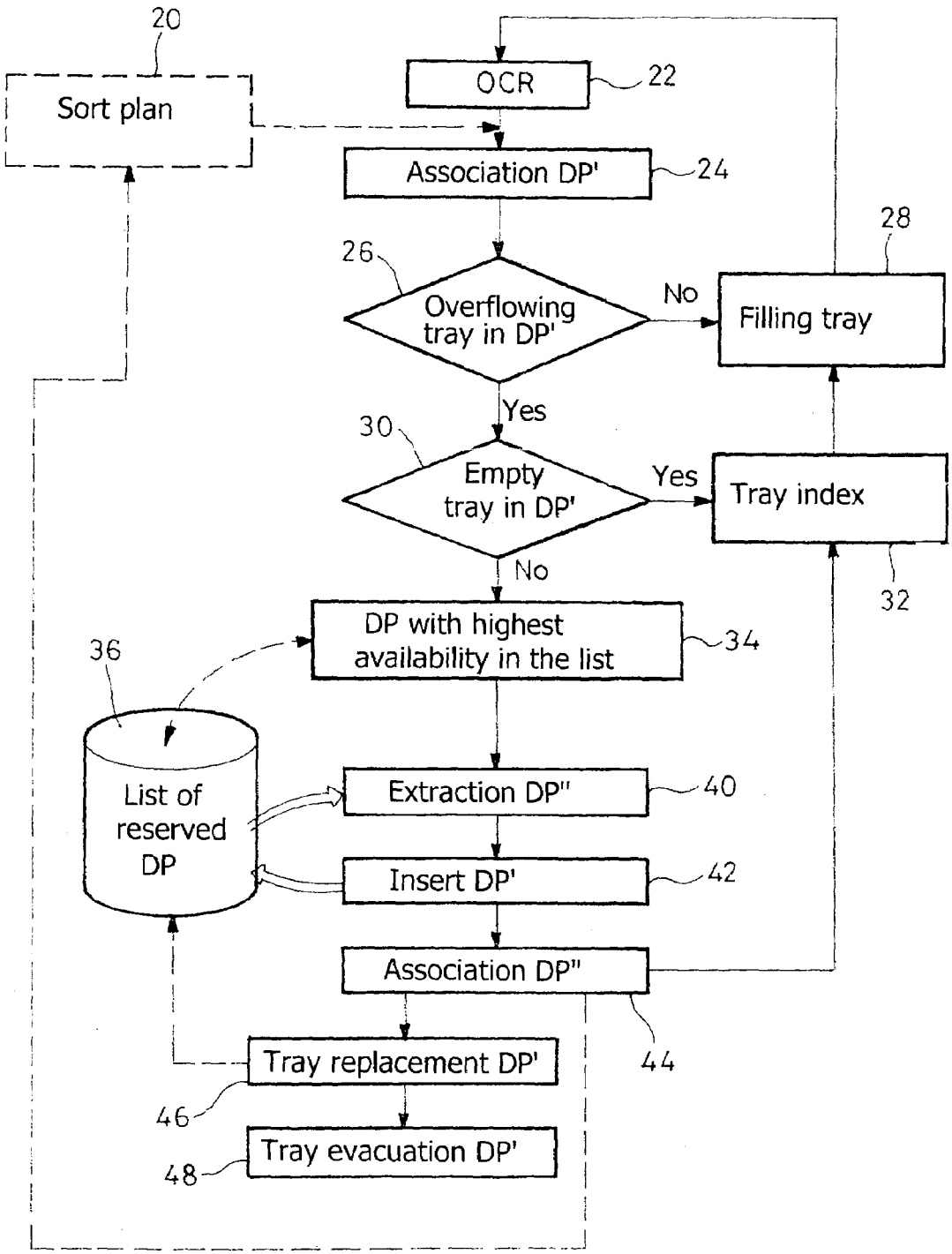
FIG. 2 is a flowchart showing different steps of the method according to the invention.

FIG. 2 shows the different steps of the method according to the invention. This method can be applied more particularly to a machine sorting process in two sorting passes to prepare the carrier walk in which a certain order between the reception trays must be preserved at the end of the sorting passe, but it is also applicable to any type of postal sorting.

The order in which the trays have to be regrouped at the end of the passe is imposed by a sorting plan 20 which by the way gives the correspondence between the logical destinations and the addresses and associates the logical destinations to the sorting outlets. The sorting plan 20 evolves dynamically, i.e. the sorting outlets associated to the logical destinations can change during the sorting process. The sorting process begins with a predefined sorting plan, established in such a way that to each logical destination is associated to a sorting outlet and that a certain number of sorting outlets said of reserve are not associated to any logical destination (free of association) and form a reserve of outlets usable in case of overflow in a sorting outlet. Each of this reserved sorting outlet can be associated at a given time to anyone of the logical destinations and is not potentially associated to a particular logical destination.

A current postal object E is depilated in the sorting machine 1. A digital image of this current postal object E is extracted in order to perform a step 22 of OCR automatic address recognition. At step 24, the logical destination DL of the current object E and the sorting outlet or physical direction DP' associated to the logical destination DL are determined based on the address of the current object and of the current sorting plan 20.

Then, it is determined if a tray arranged to receive the current object E will be available in the physical direction DP' at the time the current object E will be deposited in the physical direction DP', i.e. it is detected if the physical direction DP' is or not in overflow state.

For that, it is determined at step 26 if a tray replacement will take place in the physical direction DP' just before depositing the current object E in the physical direction DP', i.e. between the deposit of the object preceding the current object and directed to the physical direction DP' and the deposit of the current object. For that, the technique used to appreciate by anticipation the filling of the trays and to control the tray replacement, based on the knowledge of the cumulated measured thickness of the postal objects preceding the current object and directed to the physical direction DP', is used. If the tray of the physical direction DP' is not full and can receive the current object E, this tray is filled at step 28 with the current object by directing the current object towards the physical direction DP' and the process loop back to step 22 for the treatment of the object following the current object E.

If a tray replacement has to be performed just before the deposit of the current object E, it is determined at step 30 if this tray replacement can be finalized before the deposit of the current object E.

For that, the time interval between the deposit of the postal object preceding the current object and directed towards the physical direction DP' (after which the tray replacement starts) and the deposit of the current object in this same physical direction DP' is compared with a threshold corresponding to the maximal duration of a tray replacement which is around five seconds. If the time interval between the two objects is superior to said threshold, it can be deduced that the tray replacement will be finished and that an empty tray will be present in the physical direction DP', ready to receive the current object. An index, representative of the logical destination DL associated to the physical direction DP' and of a chronological order number of the association of the trays to this logical destination DL, is then associated at step 32 to the empty tray, i.e. that a fourth tray associated to this logical destination presents a chronological order number four and this independently of the physical direction in which it is disposed. The current object is directed towards the physical direction DP', the new tray of the physical direction DP' is filled with the current object at step 28 and the process is looped back to step 22 for the treatment of the object following the current object E. The index of the trays is computerized and set in correspondence a single label of the tray (bar code) with the index.

If the time interval between the two objects is inferior to said threshold, it is deduced that no tray will be available in the physical destination DP' to receive the current object and that the physical direction DP' will be in overflow state, and the process continues at step 34. At step 34, the reserved physical direction that presents the highest availability level and the most advantageous position in the sorting machine is searched in a logical waiting list 36 of reserved physical directions. The reserved physical directions are physical directions to which no logical destination is associated and that are available to overcome the overflowing problems.

Figure 3:
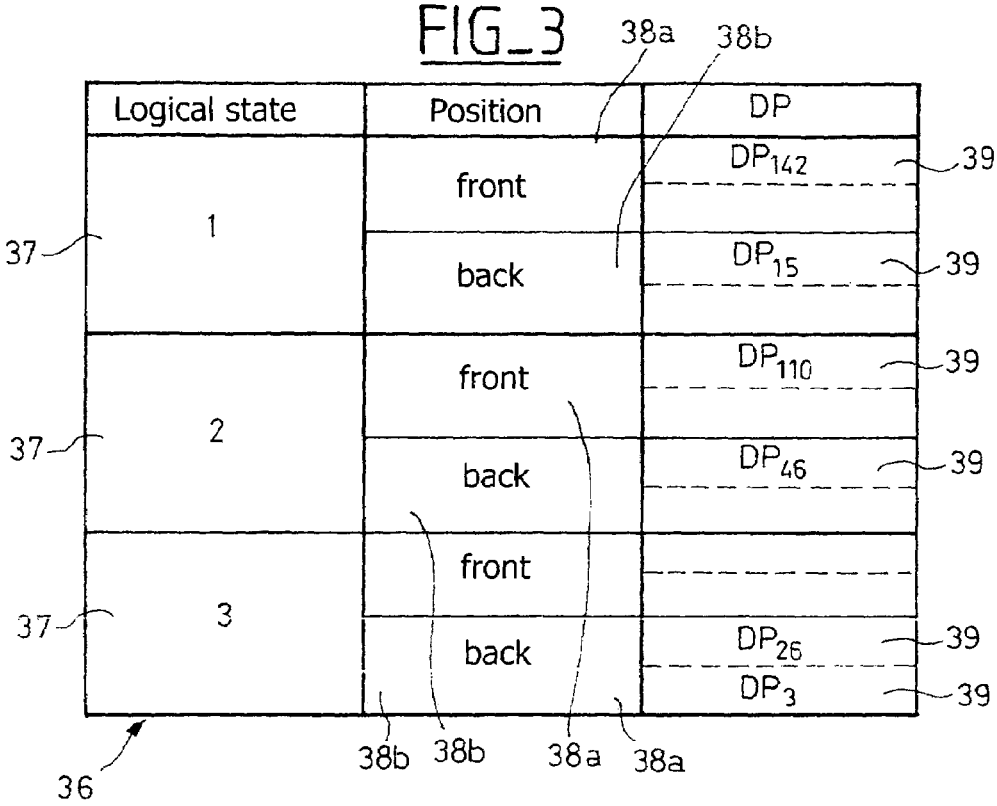
FIG. 3 is a representation of a logical waiting list of reserved physical directions.

The logical waiting list 36, shown in FIG. 3, is a list which index the reserved physical directions and classify those reserved physical directions on the basis of their availability. The reserved physical directions are classified according to different logical states 37 whose characterize their availability levels and more particularly of availability of an empty tray. The reserved physical directions having a same logical state can be classified advantageously according to the position 38 of those physical directions in the machine.

The list of FIG. 3 presents three different logical states 37 and two different positions 38*a*, 38*b* for each logical state.

The logical states characterizing the reserved physical directions are for example the following.

A first state characterizes any physical direction comprising an empty tray which must not receive any of the postal objects that are preceding the current object E. This state is the one in which the reserved physical directions are at the beginning of the sorting process and the one toward which every reserved physical directions of the list tend.

A second state characterizes any physical direction in which a tray replacement takes place.

A third state characterizes any physical direction which must still receive some of the postal objects preceding the current object before performing a tray replacement in this physical direction.

The positions 38*a* and 38*b* are identifying physical directions placed on opposite sides of the machine. The position 38*a* corresponds to the front face of the machine and the position 38*b* corresponds to the back face of the machine. The physical directions are classified according to their position 38*a* or 38*b* in order to balance the flow of full trays on the evacuation conveyor 9. When the full tray flow on the evacuation conveyor of the back face of the machine is superior to the tray flow on the conveyor of the front face, for a similar logical state, a physical direction positioned on the front face 38*a* will be classified before a physical direction positioned on the back face, and conversely. Thus, the position criteria 38*a*, 38*b* can inverse itself during the sorting process. Each time the position criterion changes, the machine controls automatically the updating of the logical waiting list 36.

The waiting list of FIG. 3 comprises six physical directions 39, from which the physical direction $DP_{142}$ presents the highest availability level and is positioned on the front face of the machine on which it is preferable to increase the number of used physical directions.

The physical directions are inserted in the list in the second or the third states and more generally in the third state. A third state physical direction changes to second state when the tray replacement begins and a second state physical direction changes to first state when the tray replacement is finished.

Other states can of course be added for the classifying of the physical directions in the list such as for example a waiting state for the tray replacement if the tray replacement does not start instantly or a state indicative of the number of trays foreseen by anticipation for this physical direction.

It is also possible to classify the physical directions in the list according to the time they will be provided with an empty tray, for example by determining the time at which they must receive their last object before the tray replacement.

In FIG. 2, the physical direction DP" which has the highest availability level is determined at step 34 (physical destination $DP_{142}$ with reference to FIG. 3). At step 40, this reserved physical direction DP" is extracted from the logical waiting list 36 of reserved physical directions. At the same time, the association of the logical destination DL to the physical direction DP' is removed at step 42, which physical direction DP' becomes then a reserved physical direction without association and is inserted in the logical waiting list.

Finally, at step 44, the logical destination DL is associated to the physical direction DP".

The number of physical directions indexed in the list is constant because the list is regenerated by the entrance of a physical direction when a physical direction is removed and each logical direction is associated at each time to one physical direction. This list evolves dynamically in real time because of the constant evolution of the logical states of the reserved physical directions and of the full tray flows on the evacuation conveyors.

When at step 42 the physical direction DP' is inserted in the logical waiting list 36 and postal objects preceding the current object are still in the buckets of the carrousel and directed toward the physical direction DP', the physical direction DP' presents the characteristics of the third logical state. When the tray of the reserved physical direction DP' is full, a tray replacement is performed at step 46 and, at the beginning of the tray replacement, an information is sent to the logical waiting list 36 in order to move the physical direction DP' to the second logical state, and at the end of the tray replacement when an empty tray is available in the physical direction DP', an information is sent to the logical waiting list 36 in order to moves the physical direction DP' to the first logical state. The classification of the reserved physical directions in the waiting list is reevaluated each time the logical state of a reserved physical direction changes.

After the association of the physical direction DP" to the logical destination DL at step 44, an index representative of the logical destination DL and of the chronological order number of the association of the trays to this logical destination DL is associated at step 32 to the empty tray of the physical direction DP". The current object is then directed toward the physical direction DP" and the empty tray of the physical direction DP" is filled with the current object E at step 28 before to loop back to step 22 for the treatment of the object following the current object.

The removal of the association of the logical destination DL to the physical direction DP' and the association of the physical direction DP" to the logical destination DL at step 44 are reported into the current sorting plan 20.

During a tray replacement, an empty tray replaces a full tray and the full tray is pushed onto the evacuation conveyor 9 circulating along the physical directions and the full tray is evacuated of the sorting machine, as for example, at step 48.

The tray evacuation permit not to be saturated with trays near the physical directions and thus to be able to re-feed constantly the logical waiting list.

For the preparation of the carrier walk, during which the order of the trays has to be preserved, the full trays are conveyed up to a tray sequencing device, for example a conveyor with storing ways associated to a system of traceability of the trays (bar codes—optical reader—data base), that reestablished the tray order using the index of the trays. The trays are sequenced in the desired order by reading the labels of the trays and on the basis of the index performed during the sorting process. This evacuation and sequencing of the trays permit to get rid of any restriction for the position of the physical directions in the machine, or the one with respect to the others, to choose the physical direction to associate to a logical destination.

Figure 4:
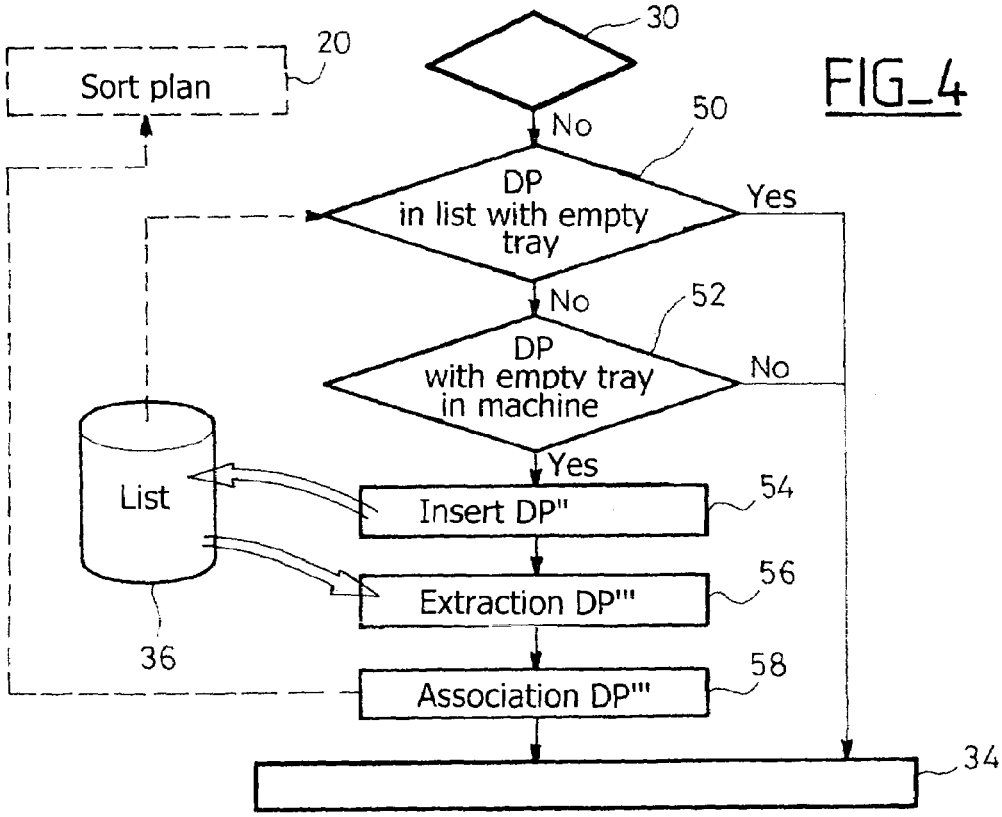
FIG. 4 is a flowchart showing an other way to implement the method according to the invention.

According to an other way to implement the method according to the invention illustrated in FIG. 4, a permutation between physical directions associated to logical destinations and reserved physical directions of the waiting list is performed in order to obtain an availability level for the reserved physical directions of the list sufficient to solve the overflowing problem in a physical direction. The aim of the above permutation is to obtain if possible at least a reserved physical direction with an empty tray in the waiting list in order to send the object of an overflowing physical direction into an empty tray.

For this, several updating steps of the logical waiting list 36 are performed between the steps 30 and 34 of the method previously described with reference to FIG. 2.

When it is determined at step 30 that no tray will be available in the physical direction DP' to receive the current object, the process follows at step 50 in which it is determined if the logical waiting list 36 comprises a reserved physical direction with an empty tray, i.e. being in the first logical state. If the list 36 comprises a reserved physical direction with an empty tray, the process continues at step 34 in which the more available reserved physical direction of the waiting list comprises an empty tray and can receive postal objects.

Otherwise all the physical directions of the machine are scanned in order to determine if a physical direction comprises an empty tray. If no physical direction comprises an empty tray, the process continues at step 34.

If at least a physical direction DP" comprises an empty tray, for example because this tray has been replaced a few time before and no object has been associated to this tray yet, a permutation is performed between this physical direction DP" and a reserved physical direction DP"' of the waiting list. The logical destination associated to this physical direction DP" is removed and this physical direction DP" without association is inserted (step 54) in the logical waiting list 36. In the same time a reserved physical direction DP"' is extracted from the logical waiting list 36 (step 56) and the logical destination previously associated to the physical direction DP" is associated (step 58) to this physical direction DP"'. The permutation between the physical direction DP" and DP"' is impacted on the sorting plan as well as on the tray index.

The logical waiting list presents then a reserved physical direction DP"with an empty tray, i.e. with the first logical state. The process is followed then at step 34 during which this physical direction DP" will be identified as the one having the highest availability level of the waiting list 36.

Of course, if several physical directions of the machine comprises empty trays, the physical direction DP" will be chosen on preferred position criteria in the machine. The physical direction DP"' extracted from the list 36 can been chosen as well according to preferred position criteria in the machine.

If several physical directions of the machine comprise empty trays, it is also possible to permute several of this physical directions with physical directions of the list in order to refresh this later, and in particular to balance the full tray flow onto the evacuation conveyors.

The invention is also applicable when the trays do not have to be necessarily evacuated of the sorting machine in a precise order, for example in the case of routing sorting in which the trays are separated in several categories at the end of the sorting process based on an index of the trays with regard to the logical destination associated to the objects sorted in those trays.

It is possible to take into account the fact that a tray replacement encounters problems and is longer to be performed or unworkable. The duration of the tray replacements can be preferably estimated one by one for each physical direction with respect to data provided by the automatic tray handling system that manages the tray replacements. The association of a logical destination to a physical direction is preferably provided as early as possible and reevaluated each time the accessibility to this physical direction is likely to be changed. The aim is to fully take advantage of the anticipation while adapting at best to the sorting risks that can affect the nominal operation of the machine.

The invention claimed is:

1. A method for sorting postal objects in a sorting machine comprising sorting outlets with movable trays for the storage of the postal objects, in which respective logical destinations are associated to the sorting outlets and, some sorting outlets of the machine are reserved, called reserved sorting outlets, without logical destination association, and in which in case of the detection of an overflow of a tray in a sorting outlet, the postal objects intended to this overflowing sorting outlet are directed to a reserved sorting outlet and the logical destination of the overflowing sorting outlet is associated to this reserved sorting outlet, wherein the method comprises the steps consisting in:

a) extracting said reserved sorting outlet in a logical waiting list of reserved sorting outlets;

b) associating to the empty tray of the reserved sorting outlet an index representative of a chronological order association number of the association of a tray to a logical destination;

c) inserting the overflowing sorting outlet in said waiting list of reserved sorting outlets, loading an empty tray in the overflowing sorting outlet in the place of the full tray and evacuating the full tray of the sorting machine.

2. The method according to claim 1, in which different logical states are given to the sorting outlets, this logical states corresponding to different availability levels of the sorting outlets and, the sorting outlets are classified in said logical waiting list on the basis of their availability, and in which the reserved sorting outlet extracted at step a) in the logical waiting list is the one with the highest availability level.

3. The method according to claim 2, in which the classification of the reserved sorting outlets in the waiting list is re-evaluated each time a sorting outlet is inserted into the logical waiting list.

4. The method according to claim 2, in which the reserved sorting outlets with the same logical state are classified according to their position in the machine in order to balance the flow of the full trays onto full tray evacuation conveyors placed on each side of the machine.

5. The method according to claim 4, in which the classification of the reserved sorting outlets in the waiting list is re-evaluated each time a sorting outlet is inserted into the logical waiting list or each time a logical state of a reserved sorting outlet changes.

6. The method according to claim 2, in which a sorting outlet associated to a logical destination is permuted with a reserved sorting outlet of the logical waiting list when the availability level of said sorting outlet associated to a logical destination is higher than the availability levels of the reserved sorting outlets.

* * * * *